US006385798B1

(12) United States Patent
Burns et al.

(10) Patent No.: US 6,385,798 B1
(45) Date of Patent: May 14, 2002

(54) TOP MOUNT FAUCET VALVE BODY

(75) Inventors: Leonard J. Burns, Lorain; Nicholas A. Mascari, Newburgh Heights; Martin Zummersch, Westlake, all of OH (US)

(73) Assignee: Moen Incorporated, North Olmstead, OH (US)

( * ) Notice: Subject to any disclaimer, the term of this patent is extended or adjusted under 35 U.S.C. 154(b) by 0 days.

(21) Appl. No.: 09/746,624

(22) Filed: Dec. 22, 2000

(51) Int. Cl.[7] ..... E03C 1/04

(52) U.S. Cl. ..... 4/675; 4/696; 137/359; 137/801; 285/64

(58) Field of Search ..... 4/675–678, 696; 137/359, 360, 801; 285/64, 208, 210, 217

(56) References Cited

U.S. PATENT DOCUMENTS

| | | | |
|---|---|---|---|
| 1,960,278 | A | 5/1934 | Niedecken |
| 3,010,474 | A | 11/1961 | Moen |
| 3,785,396 | A | 1/1974 | Morris et al. |
| 3,790,966 | A | 2/1974 | Keane |
| 4,005,883 | A | 2/1977 | Guest |
| 4,281,857 | A | 8/1981 | Randall |
| 4,356,574 | A | 11/1982 | Johnson |
| 4,553,277 | A | 11/1985 | Duncan |
| 4,654,900 | A | 4/1987 | McGhee |
| 4,671,316 | A | 6/1987 | Botnick |
| 4,760,861 | A | 8/1988 | Botnick |
| 4,762,143 | A | 8/1988 | Botnick |
| 4,848,395 | A | 7/1989 | Krippendorf |
| 4,852,192 | A | 8/1989 | Viegener |
| 4,967,784 | A | 11/1990 | Barhydt, Sr. et al. |
| 4,998,555 | A | 3/1991 | Barhydt, Sr. et al. |
| 5,010,922 | A | 4/1991 | Agresta |
| 5,127,427 | A | 7/1992 | Kajpust et al. |
| 5,213,268 | A | 5/1993 | Gnauert et al. |
| 5,232,008 | A | 8/1993 | Jeffress et al. |
| 5,361,431 | A | 11/1994 | Freier et al. |
| 5,388,287 | A | 2/1995 | Tischler et al. |
| 5,465,749 | A | 11/1995 | Sauter et al. |
| 5,515,882 | A | 5/1996 | Hennis |
| 5,558,128 | A | 9/1996 | Pawelzik et al. |
| 5,584,513 | A | 12/1996 | Sweeny et al. |
| 5,660,203 | A | 8/1997 | Gnauert et al. |
| 5,822,811 | A | 10/1998 | Ko |
| 5,865,211 | A | 2/1999 | Thomas |
| 5,946,746 | A | 9/1999 | Bloom |
| 5,983,917 | A | 11/1999 | Thomas |
| 6,014,985 | A | 1/2000 | Warshawsky |

FOREIGN PATENT DOCUMENTS

| | | |
|---|---|---|
| EP | 0 213 656 | 3/1987 |

*Primary Examiner*—Charles R. Eloshway
*Assistant Examiner*—Tuan Nguyen
(74) *Attorney, Agent, or Firm*—Cook, Alex, McFarron, Manzo, Cummings & Mehler, Ltd.

(57) ABSTRACT

A plumbing fixture adapted to be installed from the top side of a sink deck through a sink deck opening includes a valve body having an exterior threaded portion of a size to pass through the sink deck opening. There is a shoulder on the valve body which is adapted to seat upon the sink deck when the threaded portion extends through the sink deck opening. A threaded collar is mounted on the valve body threaded portion with the collar being of a size to pass through the sink deck opening. A collapsible sleeve is coaxial with the valve body and positioned thereon between the collar and the shoulder, the sleeve having an outer diameter, when collapsed, which will permit the sleeve to pass through the sink deck opening. Rotation the valve body from above the sink deck, after the threaded portion, collar and collapsible sleeve have been passed through the sink deck opening, causes the collar to move on the valve body toward the underside of the sink deck to axially compress and radially expand the collapsible sleeve until the valve body is secured to the sink deck between the valve body shoulder and radially expanded collapsible sleeve.

6 Claims, 1 Drawing Sheet

Fig. 1.
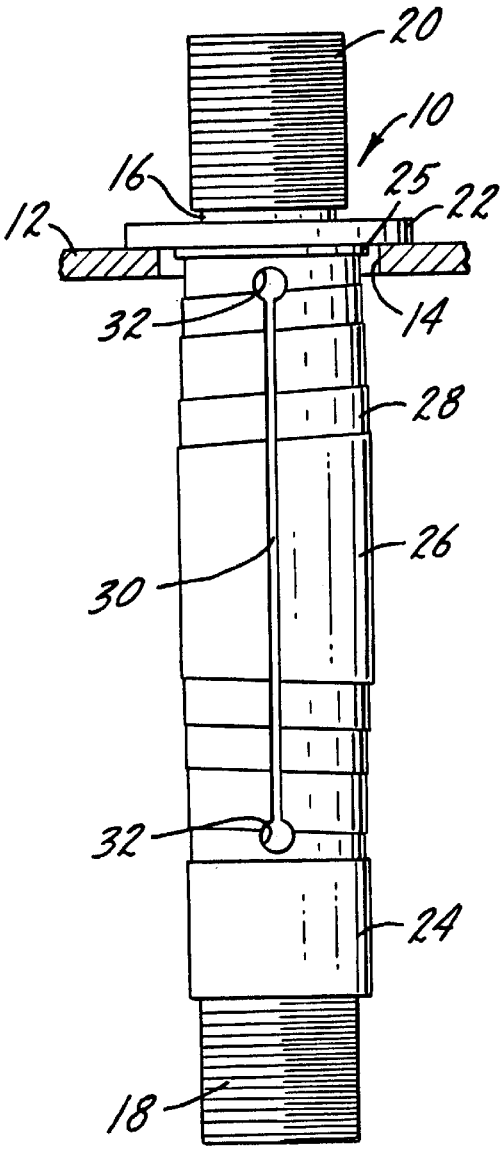
Fig. 2.
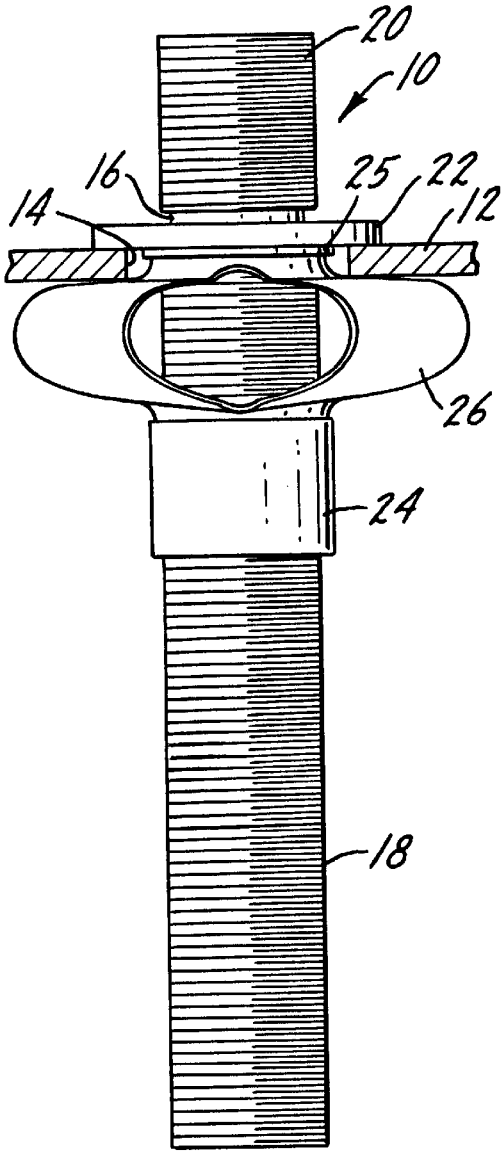
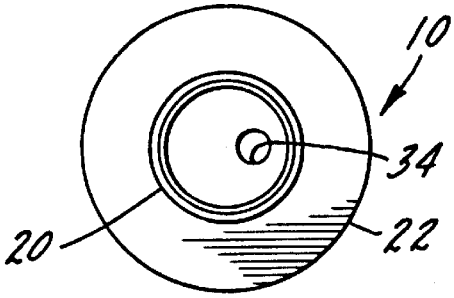
Fig. 3.

TOP MOUNT FAUCET VALVE BODY

THE FIELD OF THE INVENTION

The present invention relates to plumbing fixtures such as used in connection with kitchen and bathroom faucets, soap dispensers, kitchen side sprays and other water usage plumbing products customarily mounted to a sink deck, either in a kitchen or bathroom environment. In the traditional method for installing such sink plumbing fixtures, a substantial portion of the labor is done from the area beneath the sink deck. This is a crowded and uncomfortable work environment. The present invention provides a plumbing fixture in which a major portion of the installation work can be done totally from above the sink, with the only work that need be done beneath the sink deck being the installation of a plumbing fixture hose to a water inlet pipe.

The plumbing fixture comprises a valve body, which may house a faucet valve or other water control device, and has a threaded portion of a size to pass through an opening in the sink deck. There is a shoulder on the valve body which will seat upon the sink deck and which has an outer diameter larger than the sink deck opening. A threaded collar is mounted on the valve body and is of a size to pass through the sink deck opening. There is a collapsible plastic sleeve which is coaxial with and mounted on the threaded portion of the valve body, connected to the threaded collar and bottoms against the shoulder. When the sleeve is collapsed, it can pass through the sink deck opening. Rotation of the valve body from above the sink deck will cause the threaded collar to move on the valve body toward the underside of the sink deck, causing the collapsible plastic sleeve to axially compress and radially expand, with the end result being that the valve body is attached to the sink deck by the shoulder on the top side of the sink deck and the collapsible sleeve on the underside of the sink deck.

SUMMARY OF THE INVENTION

The present invention relates to plumbing fixtures which are formed and adapted to be mounted to a sink deck from above the deck.

A primary purpose of the invention is to provide a plumbing fixture, usable with a variety of water control plumbing devices, which is mounted to the sink deck and is formed from a minimum of reliable and compact components.

Another purpose of the invention is to provide a plumbing fixture comprising a valve body having a threaded portion and a shoulder, with a collar being mounted on the threaded portion and a collapsible sleeve being mounted between the collar and the shoulder. Rotation of the valve body causes the collapsible sleeve to compress against the underside of the sink deck to mount the valve body to the sink deck.

Other purposes will appear in the ensuing specification, drawings and claims.

BRIEF DESCRIPTION OF THE DRAWINGS

The invention is illustrated diagrammatically in the following drawings wherein:

FIG. 1 is a side view, showing the sink deck in section, of the plumbing fixture of the present invention, with the collapsible sleeve in an extended or collapsed position;

FIG. 2 is a side view, similar to FIG. 1, but showing the collapsible sleeve in a compressed position locking the valve body to the sink deck; and FIG. 3 is a top view of the valve body of FIGS. 1 and 2.

DESCRIPTION OF THE PREFERRED EMBODIMENT

The plumbing fixture of the present embodiment is indicated generally at 10 and may be used to mount a kitchen faucet, a bath or lavatory faucet, or portions of such water control plumbing devices. For example, the plumbing fixture 10 may mount the individual handles of a two-handle faucet or the spout nipple of such a faucet, as well as the control body of a single lever mixing faucet. The plumbing fixture may be used to mount a side spray of the type commonly found on a kitchen deck. In any of such uses, the plumbing fixture will have provision for a water supply hose to be connected at the below deck end and the water control plumbing device will be mounted on the top side, above the sink deck.

A particular advantage in the plumbing fixture shown herein is that it may be mounted completely from above the sink deck, avoiding the necessity of a plumber working in the cramped environment below the sink deck. The only below deck connection may be a water supply hose.

The sink deck is indicated at 12 and has an opening 14, which opening is of a size sufficient to pass portions of the plumbing fixture as described hereinafter.

The plumbing fixture 10 includes a valve body 16 having a threaded portion 18 which is of a size to pass through the sink deck opening 14. There is a second threaded portion 20 which is above the sink deck and this will customarily be used to mount the water control plumbing device. Integral with the valve body 16, or separately secured thereto, is a shoulder or flange 22, with the exterior diameter of the flange being greater than the diameter of the sink deck opening 14 to the end that when the plumbing fixture valve body is mounted on top of the sink, the shoulder will prevent the entire valve body from passing through the sink deck opening.

Mounted on the threaded portion 18 of the valve body 16 is a cylindrical collar 24 which, upon rotation of the valve body 16, will move axially along the threaded portion 18 from the initially installed position of FIG. 1 to the finally installed position of FIG. 2.

Located between the collar 24 and the shoulder or flange 22 is a collapsible plastic sleeve 26 which is attached to the collar. The sleeve is in the form of a bellows and has an outer diameter, when in the fully collapsed position of FIG. 1, that will permit the sleeve and the collar 24 to pass through the sink deck opening 14. The sleeve 26 may be formed of a plurality of telescopic individual sections, such as shown at 28 in FIG. 1, or in the alternative, the sleeve may be a single bellows-like element. There are a pair of diametrically opposed, axially extending slots or grooves 30 in the sleeve 26 which have the effect of dividing the collapsible sleeve into two symmetrical sections. There is an enlarged opening 32 at the upper and lower ends of each slot 30. A small projection 25 of the sleeve 26 bears against the underside of shoulder 22. As shown in FIG. 3, there is a water supply opening 34 in the valve body 16 to provide for a water connection to the hollow interior of the valve body.

In installation, the components of the plumbing fixture will be in the position shown in FIG. 1. The threaded portion 18, the collar 24, and the collapsible sleeve 26 all will be passed downwardly through the sink deck opening 14, with the shoulder 22 resting on the upper surface of the sink deck. From above the sink deck the installer then rotates the valve body 16 in a counterclockwise direction. Such rotation causes the collar 24 to move on the threads of the valve body portion 18 upwardly toward the underside of the sink deck.

Friction between the underside of shoulder 22 and sleeve projection 25 prevents rotation of the sleeve and collar with the valve body. This movement of the collar causes the collapsible sleeve 26 to axially compress and to radially expand, ultimately to the installed position of FIG. 2. The collapsible sleeve 26 is located between the collar and the shoulder 22 and there may be, if needed, bearing surfaces between the upper surface of the sleeve and the underside of the shoulder, and the upper surface of the collar and the underside of the sleeve. The sleeve will not be attached to either the collar or the shoulder, but will be independent of these elements so that the sleeve does not rotate as the valve body 16 is turned.

The plumbing fixture will be fully installed when the collar has been rotated a distance on the threaded portion 18 such that the collapsible sleeve bears against the underside of the sink deck. The fixture is then held to the deck by the shoulder 22 on the top side and the collapsed sleeve on the bottom side. This installation takes place with no need for the installer to be beneath the sink deck.

If the plumbing fixture is to be removed, the above-described process is reversed, again without the necessity of the installer being positioned or located beneath the sink deck.

Although the invention has been described as using rotation of the valve body to raise and lower the collar, it is also possible to use an offset screw, accessible from above the sink deck, to provide collar movement.

Whereas the preferred form of the invention has been shown and described herein, it should be realized that there may be many modifications, substitutions and alterations thereto.

The embodiments of the invention in which an exclusive property or privilege is claimed are defined as follows:

1. A plumbing fixture adapted to be installed from the top side of a sink deck through a sink deck opening, said fixture including a valve body having an exterior threaded portion of a size adapted to pass through the sink deck opening, a shoulder on said valve body adapted to seat upon the sink deck when the exterior threaded portion of the valve body extends through the sink deck opening, a threaded collar mounted on said valve body threaded portion, said collar being of a size adapted to pass through the sink deck opening, and a collapsible sleeve coaxial with said valve body and positioned thereon between said collar and shoulder, said collapsible sleeve having an outer diameter, when collapsed, which will permit the sleeve to pass through the sink deck opening, rotation of said valve body from above the sink deck, after the valve body threaded portion, collapsible sleeve and collar have been passed through the sink deck opening, causing said collar to move on the valve body threaded portion toward the underside of the sink deck to axially compress and radially expand the collapsible sleeve until the valve body is secured to the sink deck between the valve body shoulder and the radially expanded collapsible sleeve.

2. The plumbing fixture of claim 1 wherein said collapsible sleeve has one end attached to said collar and the other end terminates at an underside of the shoulder.

3. The plumbing fixture of claim 2 wherein said sleeve includes an annular projection at an upper end thereof bearing against an underside of said shoulder to provide frictional resistance to rotation of said sleeve and collar.

4. The plumbing fixture of claim 1 wherein said collapsible sleeve has at least one axially extending opening, which opening extends substantially the entire length of the collapsible sleeve.

5. The plumbing fixture of claim 4 wherein there are a pair of axially extending openings, said openings dividing said sleeve into sleeve portions permitting the radial expansion of said sleeve as the collar is moved toward the shoulder.

6. The plumbing fixture of claim 1 wherein said collapsible sleeve is made of a plastic.

* * * * *